US005542995A

United States Patent [19]

Reilly

[11] Patent Number: 5,542,995

[45] Date of Patent: Aug. 6, 1996

[54] METHOD OF MAKING STEEL STRAPPING AND STRIP AND STRAPPING AND STRIP

[76] Inventor: Robert Reilly, 985 Pine Tree La., Winnetka, Ill. 60093

[21] Appl. No.: 168,512

[22] Filed: Dec. 16, 1993

Related U.S. Application Data

[63] Continuation of Ser. No. 839,125, Feb. 19, 1992, abandoned.

[51] Int. Cl.[6] ..... C21D 7/00

[52] U.S. Cl. ..... 148/630; 148/598; 148/600; 148/645; 148/653; 148/654; 148/655

[58] Field of Search ..... 148/630, 645, 148/653, 654, 655, 598, 600, 320

[56] References Cited

U.S. PATENT DOCUMENTS

| | | | |
|---|---|---|---|
| Re. 28,645 | 12/1975 | Aoki et al. | 148/12 F |
| 3,488,231 | 1/1970 | Zackey et al. | 148/12 |
| 3,645,801 | 2/1972 | Melloy et al. | 148/12 |
| 3,666,572 | 5/1972 | Nakagawa et al. | 148/134 |
| 3,683,662 | 8/1972 | Dechene et al. | 72/235 |
| 3,701,694 | 10/1972 | Osuka et al. | 148/12 |
| 3,704,180 | 11/1972 | Heitmann et al. | 148/12 |
| 3,761,323 | 9/1973 | Hunt et al. | 148/12 |
| 3,806,378 | 4/1974 | Bramfitt et al. | 148/12 |
| 3,849,209 | 11/1974 | Ishizaki et al. | 148/12 F |
| 3,860,456 | 1/1975 | Repas | 148/12 F |
| 3,918,999 | 11/1975 | Sekine et al. | 148/12 F |
| 3,925,111 | 12/1975 | Takechi et al. | 148/12 F |
| 3,926,686 | 12/1975 | Creswick et al. | 148/12 F |
| 3,928,086 | 12/1975 | Bailey | 148/12.3 |
| 3,930,907 | 1/1976 | Bailey | 148/12.3 |
| 4,008,078 | 2/1977 | Flugge et al. | 75/124 |
| 4,008,103 | 2/1977 | Miyoshi et al. | 148/12 F |
| 4,038,109 | 7/1977 | Pflieger et al. | 148/12 F |
| 4,040,872 | 8/1977 | Mudiare | 148/12 B |
| 4,050,959 | 9/1977 | Nakaoka et al. | 148/12.3 |
| 4,072,543 | 2/1978 | Coldren et al. | 148/12 F |
| 4,087,290 | 5/1978 | Kopietz et al. | 148/638 |
| 4,088,511 | 5/1978 | Rowney | 148/12 F |
| 4,115,155 | 9/1978 | Roe | 148/12 F |
| 4,142,920 | 3/1979 | Pflieger et al. | 148/653 |
| 4,149,584 | 4/1979 | Pflieger et al. | 164/415 |
| 4,159,218 | 6/1979 | Chatfield et al. | 148/12 F |
| 4,184,898 | 1/1980 | Ouchi et al. | 148/12 F |
| 4,196,025 | 4/1980 | Davies | 148/36 |
| 4,537,643 | 8/1985 | Thomas et al. | 148/602 |

FOREIGN PATENT DOCUMENTS

| | | | |
|---|---|---|---|
| 315975 | 5/1989 | European Pat. Off. | 148/630 |

OTHER PUBLICATIONS

Kopietz, "Controlled Quenching of Ferrous Metals in Sodium Polyacrylate Aqueous Solutions" Technical Paper, E. F. Houghton & Co. (1978).

Metals Handbook, ninth edition, vol. 14 Forming and Forging, p. 554, (1988).

Yusa et al., "Mechanical properties and microstructure of warm–extruded carbon steels", Oct. 1974, *Metallurgia And Metal Forming,* pp. 290–294, p. 297.

American Iron and Steel Institute, "Carbon Steel Strip", Jun. 1971, *Steel Products Manual* pp. 5, 6, 9–11, 26, 27, 46.

American Iron and Steel Institute, "Carbon Sheet Steel Coils and Cut Lengths", Apr. 1974, *Steel Products Manual* pp. 7, 8, 11–13, 91.

American Iron and Steel Institute, "Cold Rolled Flat Steel Wire", Aug. 1975, *Steel Products Manual* pp. 6, 7, 13–15.

Takeo et al., "The Direct Patenting of High Carbon Steel Wire Rod by Film Boiling", *Transactions ISU*, vol. 15, 1975, pp. 422–428.

(List continued on next page.)

*Primary Examiner*—Stanley S. Silverman
*Assistant Examiner*—Sikyin Ip
*Attorney, Agent, or Firm*—Wood, Phillips, VanSanten, Clark & Mortimer

[57] ABSTRACT

A method of making flat steel strapping or strip from rods, bars or slit steel includes the steps of heating a piece of steel to an elevated temperature greater than the upper critical temperature, hot rolling the steel and quenching the rolled steel from a temperature that is above the upper critical temperature or in the range of the lower critical temperature to the upper critical temperature.

10 Claims, 4 Drawing Sheets

OTHER PUBLICATIONS

Association of Iron and Steel Engineers, "The Making, Shaping and Treating of Steel", 10th Edition, *Latest Technology*, p. 698, pp. 782–785, 1984.

Singh et al., "Expert systems and the direct resistance annealing of copper", Sep. 1991, *Wire Journal International*, pp. 253–257.

"MartlNsite Ultra High Strength Steel for Today's Needs", Technical Brochure, Inland Steel Company. Sep. 1991.

64
48
62
46
60
44
58
42
56
40
54
38
52
36
50
78
49
76
47
74
45
72
43
H
W
70
41
39
37

64
48
62
46
60
44
58
42
56
40
54
38
52
36
50
78
49
76
47
74
45
72
43
H
W
70
41
39
37

170
162
160
156
154
136
152
158
138
144
146
150
148
134
132
164
130
166
168
142
140

METHOD OF MAKING STEEL STRAPPING AND STRIP AND STRAPPING AND STRIP

This application is a continuation of application Ser. No. 839,125, filed Feb. 19, 1992, now abandoned.

TECHNICAL FIELD

The present invention relates to a method of making steel strapping and strip, and to strapping and strip produced by the method. More particularly, the present invention relates to a method of making flat, directed temper steel strapping and strip and to strapping and strip produced by the method.

BACKGROUND OF THE INVENTION

Steel strapping and strip can have various tensile strengths and ductility depending upon the end use of the strapping or strip.

Flat steel strapping has many uses in holding together articles such as cartons, machinery to pallets, bricks, cotton, lumber to a railroad car, containers, crates, goods and the like. The thinness of the strapping permits it to slide around corners of the article without applying excess stress to the article. The lack of applying excess stress to the article is particularly important when the article is relatively readily deformable, e.g., cardboard, wood or the like, and permits a greater tension to be applied to the strapping than if a thicker product, e.g., wire, was used. The width of the strapping minimizes indentation of the corners over time which results in the strapping retaining the tension applied thereto because the shape of the strapped article is not deformed over time by the strapping. In contrast, wire is often round and has a greater thickness that increases the stressing and deformation of the article. Wire also has a thinner width that can cause indentation of the corners over time and result in a loss of tension. The flat ends of the flat strapping are easier to join together than the round ends of round wire. The flat strapping can have a strength that is equivalent to that of round wire but the strapping is much thinner than the wire. For example, 0.75 inch wide by 0.025 inch thick strapping has about the same strength as high tensile strength round wire having a diameter of 0.162 inches. Thus, the strapping has the advantage of being about 4.5 times wider and almost 6.5 times thinner than the wire.

The physical properties of the steel strapping are selected depending upon the use for the strapping.

The strapping used to hold a protective carton over machinery secured to a pallet does not experience a great load and therefore can be a lower strength strapping.

The strapping used to secure the machinery to the pallet must have a strength commensurate with the weight of the machinery because the weight of the machinery will determine the force exerted upon the strapping. The ductility, as measured by the elongation, of the strapping can be important because the strapping must be pulled tightly around the machinery to conform to the shape of the machinery. A shape having sharp corners requires a strapping having a greater ductility than a shape having round corners. Thus, the strapping may have to be strong and ducthe. Typically, standard high tensile steel strapping having a tensile strength of about 125,000 to about 145,000 pounds per square inch (psi) and an elongation in a 6 inch specimen of about 5 to about 15% that meets the Association of American Railroads (AAR) and the American Society for Testing and Material (ASTM) specifications is used to secure machinery.

The strapping used to form a cube of bricks must be strong enough to bear the load exerted on it by the bricks. The strapping must also have a high degree of ductility as the strapping must slide and bend around the sharp corners during tensioning of the strapping to form the cube. Thus, the strapping must be strong and ducthe. The strapping can be made from a dual phase steel.

The strapping used to produce cotton bales must have adequate strength to withstand the force exerted thereon when the bale is released from compression in the baling machine. The cotton bale strapping requires relatively less ductility as compared to strapping used to produce cubes of bricks because the cotton bales typically have a round cross-section. A round cross-section does not have sharp corners over which the strapping must be pulled during tensioning. Strapping having a tensile strength of about 200,000 psi is suitable for the purpose with no requirement for elongation.

Loads of material, e.g. lumber, can be secured to railroad flat cars using strapping. The lumber is first bundled together using strapping, which are referred to as "package bands", that have a cross-section in the range of about ½×0.020 to about 1 ¼×0.031 inches and that can have a strength of about 1,200 to about 4,500 lbs. Bundles are then secured to the railroad car using strapping, which are referred to as "securement bands", that have a cross-section in the range of about '¼× 0.031 to about 2×0.065 inches and that can have a strength of more than about 13,800 lbs. The securement bands must withstand the load exerted thereon by numerous bundles and have a high degree of ductility to slide around sharp corners of the bundles and of rectangular steel stake brackets on the sides of the railroad car about which the securement bands are looped and secured.

High tensile strapping is conventionally produced by slitting full hard, cold rolled sheet steel to the cross-sectional size of the strapping followed by heating to an elevated temperature. The strapping is usually quenched by immersion in a molten lead bath. This immersion of the hot steel in the molten lead bath is referred to as patenting. The range of ductility afforded by the ability to vary the quench temperature in patenting is appropriate for most steel strapping applications. Metallurgists believe the resulting grain structure is a bainite or a mixed structure of pearlite, ferrite and martensite.

Slitting results in the production of square, sharp corners and burrs that can tear the article that is strapped and that can be harmful to people who come into contact with the strapping. The sharp corners and burrs also undesirable enhances transverse crack propagation and reduce the fatigue life of the strapping which reduces the toughness of the strapping as compared to strapping having round edges. The customary burr removal operation of rolling or flattening imparts cold work stresses on the strapping edge that further exacerbate the cracking problem. Strapping produced by slitting requires numerous finishing steps after cold working, e.g., heat treating and quenching, to improve strength and ductility. These finishing steps increase the cost of the strapping.

The slitting step is often a batch step. A batch step is usually less desirable than a continuous step for the manufacture of a large volume of strapping because continuous processes are more cost efficient. In a batch step the desired amount of steel enters the step and then the step is performed on the steel. In a continuous step the steel moves continuously through the step as the step is being performed on the steel. A batch step cannot be used in a continuous process.

High tensile strength strapping can be produced from sheet steel by the steps of hot rolling, cold rolling, and slitting followed by an electric resistance heat treating process. Unfortunately, this process requires numerous steps including a slitting of the hot and cold rolled sheet that removes the edges and therefore results in a loss of finished product. Also, this process for making high tensile strapping requires slitting and therefore has the problems associated with slitting.

The strapping produced by a conventional process can have physical properties similar to or exceeding those of a mixed structure of pearlite, ferrite and martensite, which is typical of a patented or lead quenched structure by using a separate heating step followed by immediate quenching in lead to 800° to 950° F. followed by quenching in water to ambient temperature, e.g., about 60° to about 90° F. Unfortunately, additional process steps are utilized.

The strip is used to form, as by stamping, metal parts, e.g., lawn mower blades, scissor blades, and the like, that are subsequently heat treated to achieve the desired physical properties of the finished part. The strip must have the proper ductility and tensile strength to permit parts to be formed.

The strip produced by specialty steel strip manufacturers requires multiple steps including a slitting step. Generally, the manufacturer starts with a steel coil having a relatively high carbon content. The coil is formed while the steel is still hot which causes a nonuniform grain structure throughout the coil due to a differential cooling rate of the coil. In the first processing step the coil of steel is subjected to sorbitic annealing to obtain a uniform grain structure. The surface of the steel is then subjected to pickling by immersion into an acidic or alkaline solution to remove the oxide or scale coating thereon. Pickling is performed because the surface has a great effect on the next step which is cold rolling. After about a 50% cold reduction by cold rolling, the steel goes into a furnace for another intermediate annealing prior to the final cold reduction. Then, the cold rolled steel is slit to the final width of the strip. The end product is a cold worked grain structure from an annealed starting steel.

Unfortunately, the specialty steel manufacturer must slit the steel which introduces the previously discussed problems. Also, the higher carbon content steels cannot be made into the strip without intermediate annealing due to the brittleness introduced by cold rolling. Annealing is undesirable because it requires heating of the cold steel with its attendant cost. Also, annealing can be a batch step and therefore cannot be utilized in a continuous process.

Often, the strapping and the strip cannot be made on the same line due to the differences in the starting materials, in the heat treatment and the like. The owner of the line is therefore limited to producing only the strapping or the strip and cannot satisfy both markets.

There is a need for a method of manufacturing flat, directed temper steel strapping and strip that does not utilize a slitting step to reduce the steel to the cross-sectional size of the finished strapping or strip, that is preferably a continuous process, or that does not require reheating the steel after the steel has been cold worked. The present invention satisfies at least one of these needs.

SUMMARY OF THE INVENTION

The present invention is directed to a method of making flat, directed temper steel strapping or strip from a piece of steel having a thickness greater than the thickness of the strapping or strip to be made therefrom. The method includes the steps of: providing a piece of steel; heating the steel to an elevated temperature greater than the austenitizing temperature; hot rolling the steel; and quenching the rolled steel. For a dual phase steel, at least part of the hot rolling is performed at a temperature in the range of the lower critical temperature ($Ar_1$) to the austenitizing temperature and the steel is quenched from a temperature in the range. For other chemistry steel, hot rolling is performed at a temperature above the austenitizing temperature and the steel is quenched from a temperature above the austenitizing temperature. The grain structure of the strapping or strip can be a bainite grain structure, a low carbon martensitic structure or a dual phase martensitic/pearlitic or martensite in soft ferrite matrix grain structure.

A heat treatment step can be utilized to heat, hot roll and then quench the steel. The quench step has the capability to provide the very short quench time required for low carbon steels, dual phase steels and microalloyed steels. A fluidized bed can be utilized in the quench step as an alternative to a molten metal bath. Alternatively, a direct water or oil quench can be used in the quench step to achieve the desired quench. A film boiling technique can be used as an alternative in the quenching step. The quench conditions can determine whether strapping or strip is manufactured by the process.

Physical properties similar to or exceeding those of tempered martensite or bainite can be obtained by maintaining the quenched steel at a temperature effective to achieve the same.

The strapping produced by the present method has a superior edge that is rounded as a result of the elongation and reduction in cross-sectional area of the steel caused by hot rolling. The advantages of a round, smooth edge over a square, sharp edge, especially a sharp edge having burrs, is a reduction in the tendency of tearing of the article about which the strapping is wrapped, a reduction in the tendency to cut the user, a reduction in transverse crack propagation, an increase in fatigue life which increases the toughness of the strapping and elimination of the burr removal operation and hence elimination of cold work stresses imparted by the burr removal operation.

The precision in obtaining the desired dimensions and cross-sectional shape of the strapping and strip is increased by starting with a relatively narrow piece of steel and ending with a narrow piece of steel strapping or strip.

The width of the strapping and strip is controlled by a combination of factors that includes accurate control of the temperature of the steel entering the hot rolling operation, ovalization of the steel followed by rounding of the steel (for steel having a round cross-sectional and poor dimensional tolerances) and then reduction of the cross-section of the steel. A slitting step is not utilized to achieve the final reduction to the desired dimensions.

The quenching step can be followed by the optional steps of warm or cold working and applying an endothermally or exothermally cured protective coating.

Numerous other advantages and features of the present invention will become readily apparent from the following detailed description of the invention, the figures and the appended claims.

DETAILED DESCRIPTION OF THE PREFERRED EMBODIMENT

Although this invention is susceptible to embodiment in many different forms, preferred embodiments of the invention are shown. It should be understood, however, that the present disclosure is to be considered as an exemplification of the principles of this invention and is not intended to limit the invention to the embodiments illustrated.

Figure 1:
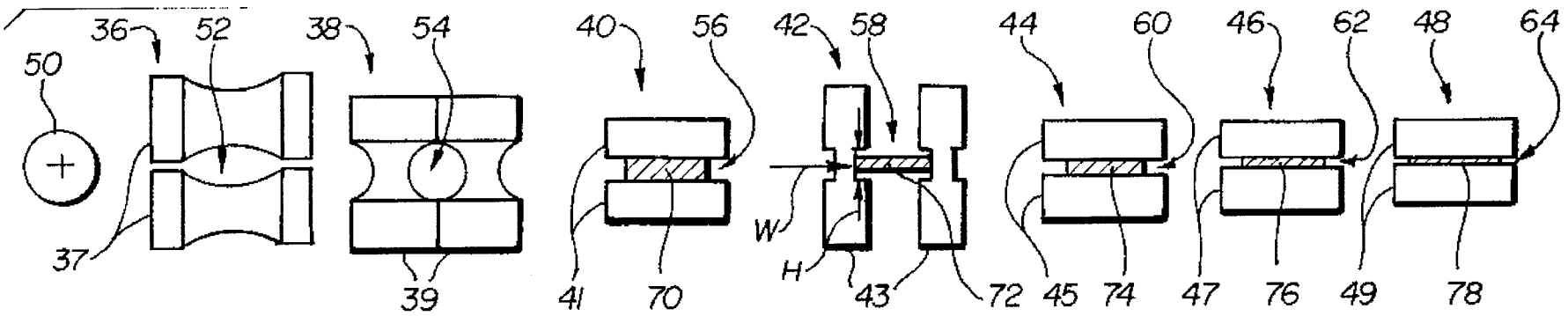
FIG. 1 is a block diagram of the method of making ducthe steel strapping.

FIG. 1 is a schematic representation of a preferred method 10 of making flat, directed temper steel strapping and strip by the present invention without the use of a slitting step to reduce the width of the starting material to the width of the strapping or strip. The first step of the method 10 is a pay-off step, represented by blocks 12A to 12D, wherein a starting material that is steel stock is dispensed and begins going through the steps of the method 10. The initial steps of the method 10, including different pay-off methods represented by the blocks 12A to 12D, depends upon the steel stock, how it is supplied and whether a continuous connected or disconnected process is desired. The steel stock can preferably be supplied as coils of round rods, round bars, slit sheet or the like. Alternatively, the steel stock can be supplied as flat bars, flat slit sheet or the like. The steel stock can have a large, medium or small cross-section.

The term "directed temper", as used in its various grammatical forms, means that the heat treatment process can be tailored to direct the temper to achieve the physical properties.

Flat steel strapping has a ratio of width to thickness in the range of about 25:1 to about 45:1. Strip has a ratio of width to thickness of about 5:1 to about 150:1.

In a "continuous connected process", as used in its various grammatical forms, successive steel stock is joined together and moves substantially continuously through the process without use of a batch step.

In a "continuous disconnected process", as used in its various grammatical forms, successive steel stock is not joined together and moves substantially continuously through the process without use of a batch step.

Figure 2:
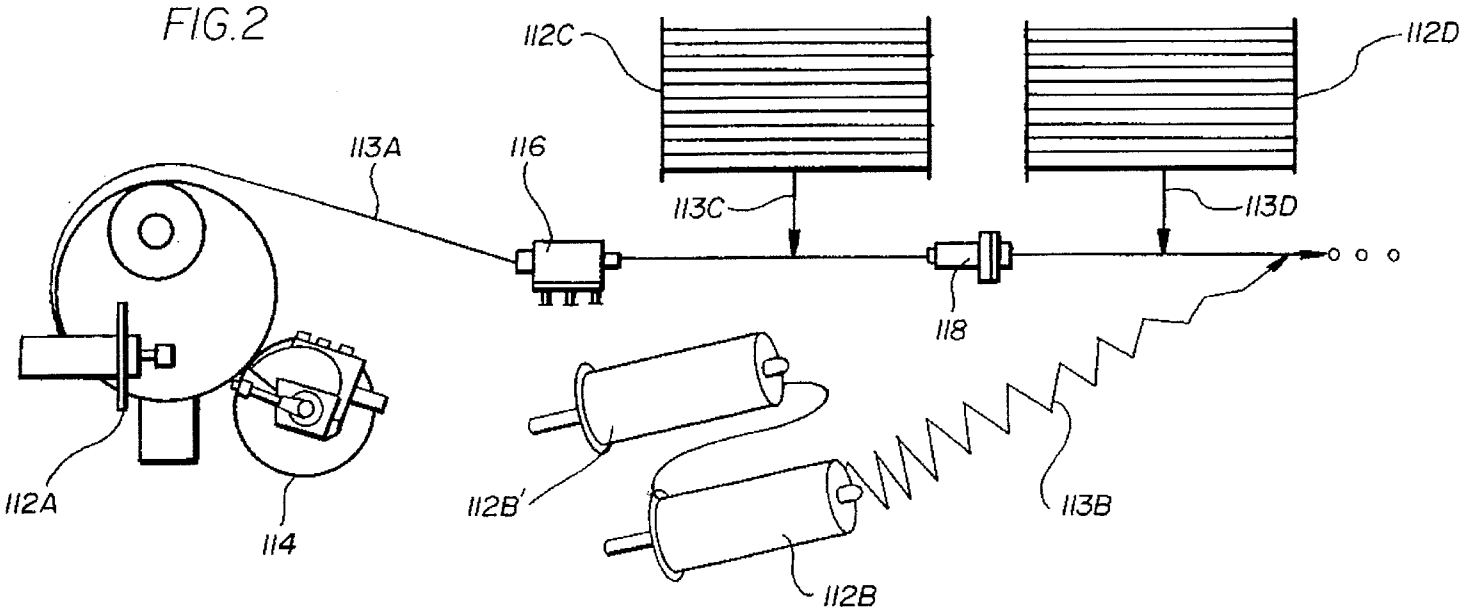
FIG. 2 is a representation of alternative pay-off steps.

Referring to FIGS. 1 and 2, when the steel stock has a large, medium or small cross-section and is supplied as a coil of rod, bar or slit steel the pay-off step is represented by block 12A and pay-off can be accomplished utilizing a rotating carousel pay-off reel 112A. Preferably, a dual station having two carousel reels is utilized so that a second coil (not shown, the second coil pay off mandrel being shown empty) can be loaded while a first coil is being paid out. The stock is quite stiff and requires mechanical assistance in being paid-off which is represented by block 14. A conventional coil opening machine 114 which peels off the outer end of the coil can be used to provide the mechanical assistance. The paid-off stock proceeds along paths 13A and 113A of FIGS. 1 and 2, respectively.

The next step for the coiled, large cross-section steel stock is a straightening step represented by block 16 wherein the coil is at least partially straightened and the coil set at least partially removed. The straightening step can be performed utilizing a conventional straightener 116.

If the steel stock is supplied as a coil of round rod or bar having a medium or small cross-section and it is desired to have a non-rotating pay-off and a continuous, connected process, the pay-off step is represented by block 12B. The steel is paid-off utilizing a conventional nonrotating pay-off machine 112B. The paid-off steel travels along paths 13B and 113B which merge with paths 13A and 113A, respectively, after a moveable welding step represented by block 18 that is performed by a conventional moveable welding machine 118. A second conventional nonrotating pay-off machine 112B' is utilized with the end of the coil on machine 112B being conventionally welded to the beginning of the coil on machine 112B'.

If the steel stock is provided as a flat bar having a pre-cut length and it is desired to have a continuous, connected process the pay-off step is represented by block 12C. The steel is paid-off utilizing a conventional flat bar pay-off machine 112C. The paid-off steel travels along paths 13C and 113C which merge with paths 13A and 113A, respectively, after the straightening step of block 16 and before the welding step of block 18. If the steel stock is provided as a pre-cut flat bar and it is desired to have a continuous, disconnected process the pay-off step is represented by block 12D. The steel is paid-off utilizing a conventional flat bar pay-off machine 112D, which is identical to the machine 112C. The paid-off steel travels along paths 13D and 113D which merge with paths 13A and 113A, respectively, after the welding step of block 18.

The next step of the method 10, when successive coils or flat bars of stock are desired to be joined, is the welding step represented by the block 18 wherein the lengths of steel stock are joined to form a continuous length of steel. A conventional welder 118 can be used to perform the welding step of block 18. The welder 118 is discussed below in more detail in connection with FIGS. 3 and 4. The welding step of block 18 is not used when a continuous, disconnected process is desired.

The next step is an optional second straightening step, represented by block 19, wherein the steel is straightened and coil set is removed. The flat bar or slit steel may not have to be subjected to the second straightening step of block 19.

The next step is a descaling step represented by block 20 wherein scaling on the steel is removed prior to further processing.

The next step is a heat treatment step represented by block 21 that at least includes heating, hot rolling and quenching steps. The heating step, represented by block 22, elevates the temperature of the steel into the desired temperature. The hot rolling step, represented by block 23, is where the steel is subjected to numerous stands that form the steel into strapping or strip or reduce the cross-section of the steel about 50% or more. The hot rolling step of block 23 is discussed below in more detail in connection with FIGS. 6 and 7.

The next step can be an optional heating step represented by block 24. A trimming unit is used in this step that adjusts the temperature of the steel to compensate for heat loss that may occur during the hot rolling step. Heat loss is more likely to occur when the steel has a small cross-section rather than large cross-section.

The next step can be an optional cutting step represented by block 25 that cuts the rolled steel substantially perpendicular to the direction of travel. In the cutting step, undesirable scrap that can be made during the process is cut out and removed. Also, the rolled steel can be cut to a desired length.

The quenching step is represented by block 26 and is shown in more detail in FIG. 8 which is discussed below. In the quenching step, the temperature of the steel is lowered from a temperature either above the austenitizing temperature [the austenitizing temperature is also referred to as the recrystallization temperature and the upper critical temperature ($Ar_3$)] or in the range of the lower critical temperature ($Ar_1$) to the upper critical temperature e.g., about 800° F. to about 1,000° F., down to ambient temperature or an isothermal transformation temperature that is below the lower critical temperature. Five alternative quenching steps can be utilized. One of the alternative quenching steps can utilize air cooling. A second alternative quenching step can utilize a molten bath of lead, zinc, zinc aluminum alloy or the like. A third alternative quenching step can utilize one or more fluidized beds. A fourth alternative quenching step can utilize a direct water quench or a direct quench into oil. A fifth alternative quenching step can utilize a film boiling technique. The quenching step can include a holding oven to complete the transformation. The product leaving the quenching step is the strapping or strip if an optional warm or cold rolling step is not performed.

The next step is the optional warm or cold rolling step represented by block 28 wherein the hot rolled and quenched steel is subjected to warm or cold rolling to produce the strapping or strip.

Optionally, the next step can be a continuous coating step represented by block 30 wherein a protective coating can be applied to the strapping or strip.

The final step is a take-off step represented by block 32 wherein the strapping or strip is collected by winding long lengths of strapping or strip into large traverse wound coils or stacking short lengths. Short lengths of strapping or strip can be taken off after the cutting step, quenching step or warm or cold rolling step.

Some of the steps of the method 10 and the equipment that can be utilized to perform the steps will now be discussed in more detail.

Figure 3:
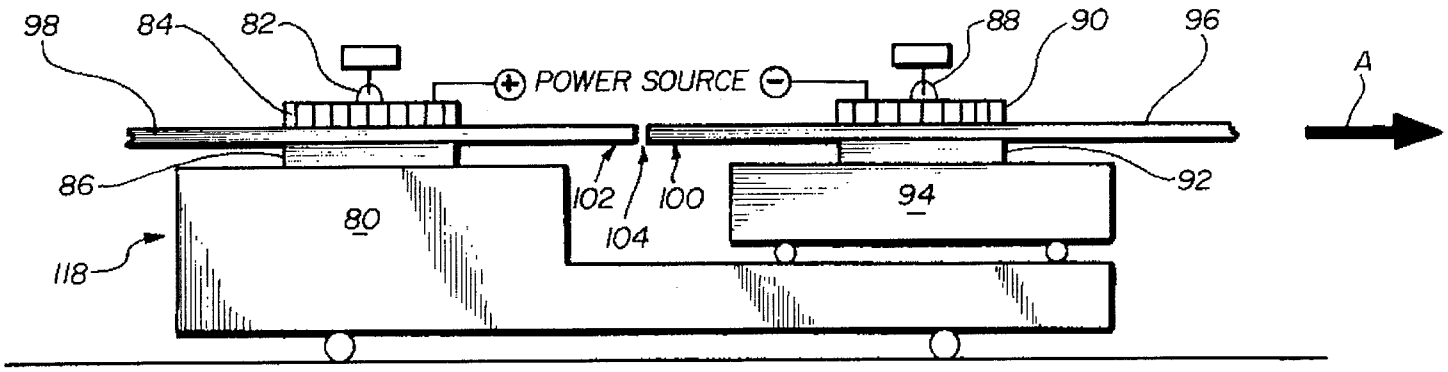
FIG. 3 is a schematic representation of a conventional welding machine.
Figure 4:
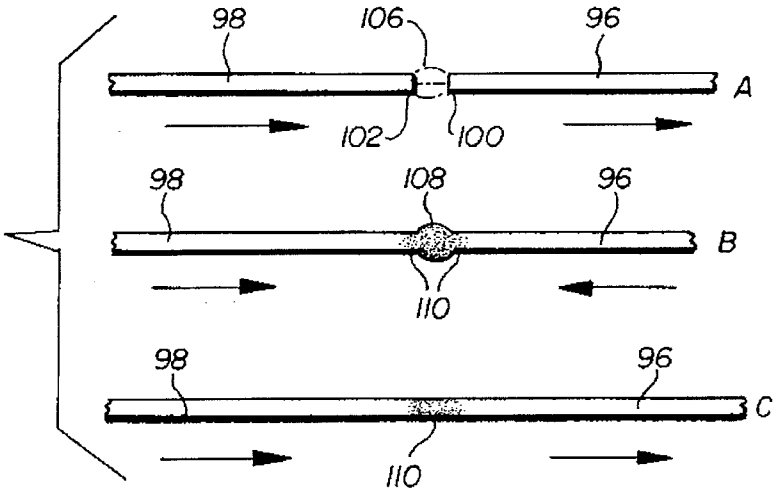
FIG. 4 is a schematic representation of the welding of two rods.

The welding step of block 18 (FIG. 1) and the conventional moveable welder 118 (FIG. 2) will now be discussed in connection with FIGS. 3 and 4. Welding can be accomplished using a conventional welder 118 that is a moving butt welder. The welder 118 has a machine base 80, a fixed clamp 82, a fixed electrode 84, a fixed isolation block 86, a movable clamp 88, a movable electrode 90, a movable isolation block 92 and a movable clamp base 94. The direction of travel of the welder 118 is indicated by the arrow labeled "A" and is the direction in which the starting material is moving.

The terms "fixed" and "movable", when used to describe the clamp, electrode, isolation block or clamp base of the welder, use the machine base 80 as a frame of reference. Therefore, an element that does not move horizontally relative to the machine base 80 is fixed whereas an element that can move horizontally relative to the machine base 80 is movable.

The operation of the welder 118 will now be discussed. A leading section 98 of the starting material to be dispensed is clamped in position by fixed clamp 82 between fixed electrode 84 and the fixed isolation block 86 to the welding machine base 80. A trailing section 96 of the starting material which has been dispensed is clamped in position by the movable clamp 88 between the movable electrode 90 and the movable isolation block 92 to the movable clamp base 94. The trailing section 96 has an end 100 and the leading section 98 has an end 102 that are positioned to provide a gap 104 therebetween. The size of the gap 104 is dependent upon the material being welded. The starting material whose trailing section 96 is clamped is moving through the steps of the process which results in the welder 118 being pulled. Welding is initiated by creating an arc 106 (FIG. 4A) that bridges the gap 104 and melts the ends 100 and 102. The arc 106 is generated by passing current from the power source through the fixed electrode 84 and movable electrode 90 and then through the leading section 98 and trailing section 96. The fixed isolation block 86 and the movable isolation block 92 insulate the welding machine base 80 and the movable clamp base 94, respectively, from the electricity. After a finite time of arcing the direction of travel of the movable clamp base 94 with the trailing section 96 fixed thereto is reversed and the movable clamp base 94 is accelerated towards the leading section 98 resulting in elimination of the gap 104 and impacting of the ends 100 and 102 (FIG. 4B). The impacting of the ends 100 and 102 result in an upset of molten material and contaminants to flow out of the impact point. This upset is termed a weld flash 108 which is subsequently removed by machining. The direction of travel of the movable clamp base 94 is again reversed so it travels in the same direction as the welding machine base 80. Upon cooling the sections 96 and 98 are welded together. The heat generated by the arc 106 creates a heat effected zone 110 that can have a metallurgical structure different than the remainder of the starting material. The heat effected zone 110 can be annealed to achieve a desired metallurgical structure including a structure substantially identical to that of the starting material. A method of annealing, which is not illustrated, is to pass an annealing current from the electrodes 84 and 90 through the heat effected zone 110 to elevate the temperature of the heat effected zone 110 thereby reheat treating the heat effected zone 110 to a metallurgical structure compatible for subsequent heat treatment. The fixed clamp 82 and the movable clamp 88 are then released to permit the welded starting material to pass therethrough. The steps are repeated to join successive trailing sections and leading sections.

Figure 5:
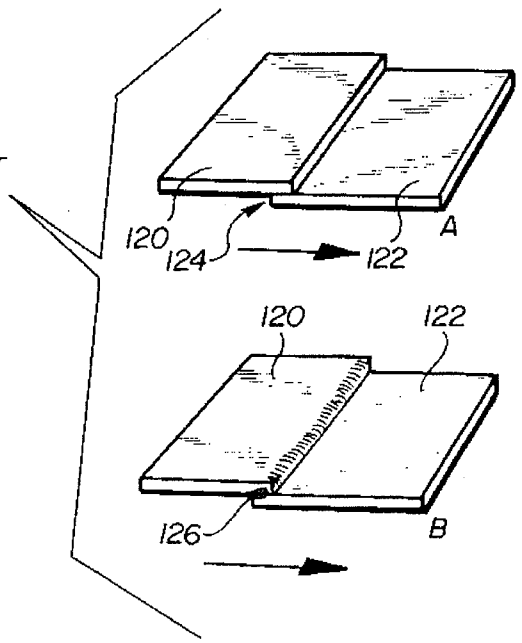
FIG. 5 PRIOR ART
FIG. 5 is a schematic representation of the welding of two sheets.

FIGS. 5A and 5B illustrate how thin sheets used in the prior art process of slitting sheets to produce strapping are welded together. As shown in FIG. 5A, sheets 120 and 122 have edges that are overlapped to produce overlapping edges 124. The sheets 120 and 122 are electric resistance welded together by rolling round electrodes (not shown) over the overlapping region 124 which welds the sheets together. As shown in FIG. 5B, welding produces a nugget 126 of steel that usually has a dendritic, cast steel microstructure. The nugget 126, due to its microstructure, does not respond to heat treatment and therefore remains as a non-ducthe stress riser in the final product which is undesirable.

In the heating step (FIG. 1, block 22), electric heating can be utilized to heat the steel stock prior to the hot rolling step (block 23). It is presently believed that electric heating provides the following benefits. Electric heating minimizes the weakening effect of contaminants in the starting material because recrystallization occurs so rapidly that the contaminants do not reach the grain boundaries where they have their greatest weakening effect. Electric heating provides more uniform heating throughout the starting material without a significant temperature gradient from the exterior to the center of the starting material. It is presently believed that the more uniform heating is beneficial to the final product.

Preferably, commercially available electric conduction heating equipment that utilizes the inherent resistance properties of the steel can be used to perform the heating step. The conductive heating equipment applies an appropriate voltage to contact rollers which in turn heat the steel stock according to the formula current (ampere) squared times resistance (ohm) equals power (kilowatts).

Figure 6:
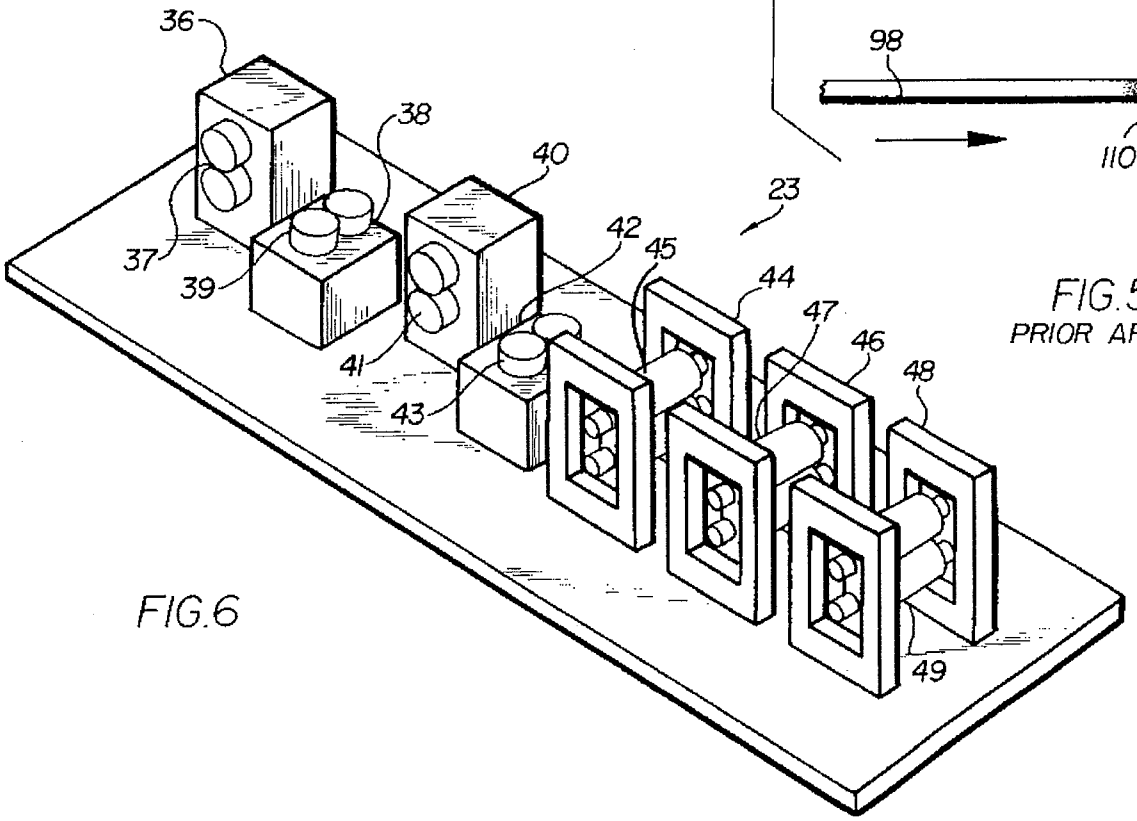
FIG. 6 is a representation of the rollers used in the hot rolling step.
Figure 7:
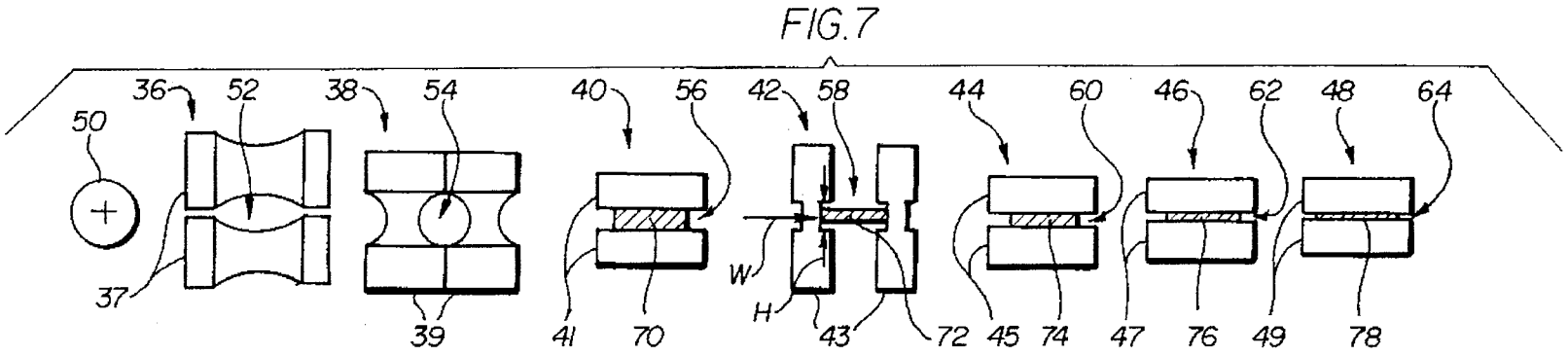
FIG. 7 is a schematic representation of the roller contact of the hot rolling step.

FIG. 6 is a more detailed schematic representation of a hot rolling step (FIG. 1, block 23) of the method 10. The hot rolling step shown in FIG. 6 is particularly well suited for starting material having a round cross-section. The hot rolling step as illustrated has seven stands, numbered 36, 38, 40, 42, 44, 46 and 48, through which the heated steel passes. It is understood that the hot rolling step can have more, or less, than seven stands. Stands 36, 40, 44, 46 and 48 have paired rollers 37, 41, 45, 47 and 49, respectively, that have axes that are substantially parallel to a horizontal plane and stands 38 and 42 have paired rollers 39 and 43, respectively, that have axes that are substantially perpendicular to a horizontal plane. FIG. 7 provides schematic representations of the roll pass design for oval, round, flat, edge, flat, flat, flat roll passes which are numbered 52, 54, 56, 58, 60, 62 and 64, respectively, for hot rolling accomplished in the seven passes, as shown in FIG. 6, of the hot rolling step. Optional trimming units, not shown, can be positioned between adjacent stands to heat and cool the heated steel to maintain the desired temperature. A representative trimming unit to reduce the temperature of the steel is a water spraying or water fogging system (not shown) that applies water to the steel to effect cooling.

The hot rolling step will now be described using FIGS. 6 and 7. The heated steel stock is received from the heating step (FIG. 1, block 22) and has a round cross-section as shown at 50. The steel can be fed into an ovalization stand 36 that ovalizes the poor dimensional tolerance round steel stock with minimal elongation and that has half oval top and half oval bottom rollers having an oval roll pass design 52. Some elongation can occur during ovalization. The ovalized steel is then fed into a precision rounding stand 38 that has precision half round left and half round right rollers 37 having a round roll pass design 54 to produce precision rounded steel. The ovalization stand 36 and the precision rounding stand 38 reduce the normal dimensional variations in the starting material. The precision rounded steel is then fed into a rectangle forming stand 40 that has flat top and bottom rollers 41 having a flat roll pass design 56 to produce rectangular cross-section steel 70. The principal work performed in rectangle forming stand 40 is elongation although some spreading can occur. The rectangular cross-section steel 70 is then fed into an edge rolling stand 42 that has rollers 43 shaped to produce an opposed channel roll pass design 58 for rolling the edges. The height "H" of the channel is greater than the thickness of the steel 70 so there is no top or bottom contact. However, the width "W" of the opening created by the channel is less than the width of the steel 70 thereby working or squeezing the edge to a narrower dimension. The edge rolling stand 42 works and rounds the edges to control the width and edge integrity and to produce edge rolled steel 72. A reduction in the width of the strapping by the edge rolling stand 42 of about 5 to about 10% is desirable. Too much reduction can make the edges of the steel thicker than the center to create a "dog bone" shape which is undesirable. The edge rolled steel 72 is then fed into three successive thickness reducing stands 44, 46 and 48 that have a first, second and third flat top and bottom rollers 45, 47 and 49, respectively, having flat roll pass designs as shown at 60, 62 and 64, respectively, to produce flattened steel 74, 76 and 78, respectively.

Alternatively, if the steel stock has a rectangular cross-section or a round cross-section with good dimensional tolerance then the ovalization stand 36 and precision rounding stand 38 can be optional and the steel stock can be fed directly into the rectangle forming stand 40. Alternatively, when utilizing narrow flat slit steel as the starting material the stands 38 and 42 are bypassed and the stand 36 has flat top and bottom rollers to provide a five stand hot rolling step. These alternatives are not illustrated.

The first thickness reducing stand 44 provides an excellent control point. The opening or closing of the rollers 45 of the stand 44 results in an increase or decrease, respectively, in the width of the finished strapping or strip without changing settings at other steps of the process. The second thickness reducing stand 46 is also sensitive to setting changes. A relatively minor change in the size of the space between the rollers 47 results in a relatively large change in the width of the finished product. The opening or closing of the rollers 47 of the stand 46 results in a decrease or increase, respectively, in the width of the finished strapping or strip.

The steel entering each of the stands must be sized to pass through the stand without slowing down or disrupting the process.

The stands of the hot rolling step (block 23) of FIG. 1 and of FIG. 6 can be conventional opposed rollers that are selected to produce the desired crosssection. The rollers 37, 39, 41 and 43 of the stands 36, 38, 40 and 42 can be canthever supported rollers. Twisting of the steel when passing through the stands 36, 48 40 and 42 can be avoided by mounting the pair of rollers in each stand alternatively in horizontal and vertical planes, i.e., stand 36 in a horizontal plane, stand 38 in a vertical plane, stand 40 in a horizontal plane and stand 42 in a vertical plane. The rollers 45, 47 and 49 of the stands 44, 46 and 48 can be overhead rollers. As shown in FIG. 6, overhead rollers are supported at both ends and canthever rollers are supported at one end.

The steel can be hot rolled to the desired thickness of the strapping or strip. Alternatively, the steel can be hot rolled to a thickness that is less than about 50% greater than the thickness of the strapping or strip. Preferably, the steel is hot rolled to a thickness that is about 20% to about 5% greater than the thickness of the strapping or strip. The final thickness reduction, if necessary, to the thickness of the strapping or strip is accomplished by the optional warm or cold rolling step (FIG. 1, block 28).

For slit sheet steel stock only a relatively minor amount of reduction, e.g., less than 50%, by hot rolling is necessary. Thus, the reduction can be achieved using stands 44, 46 and 48 by themselves.

The roller diameter for the rollers of all the stands can be 8 inches. Preferably, the roller diameter for the rollers of the ovalization stand 36 and the precision rounding stand 38 is 6 inches and for the 5 remaining stands is 8 inches.

Optionally, conventional delivery guides (not shown) that feed the steel into the stands 36, 40, 44 and 46 can be fitted with conventional edging rollers (not shown) to possibly provide a better edge appearance. The delivery guides for the third thickness reducing stand 48 preferably is not fitted with edging rollers unless greater width precision is desired.

Reduction schedules for the settings of the rollers of the stands of the hot rolling step can be determined from plots generated by the Wusatowski spread formula.

It is important to minimize or eliminate the tension in the steel moving between stands. Tension can result in a substantial narrowing of the steel. A precision speed regulation system can be used to control the speed at which the rollers are driven to minimize tension. With proper regulating, output speeds of 6,000 feet per minute (fpm) can be achieved for steel strapping or strip having a relatively small cross-section.

To perform the cutting step (FIG. 1, block 24) the process is stopped, the steel is clamped downstream of the cutting step, the process upstream of the cutting step is slowly started and off grade rolled steel is chopped up and removed. When good quality rolled steel is again being produced, the process is stopped, a repair weld is made and the process restarted.

A trimming unit can be utilized to perform a heating step (FIG. 1, block 25) to elevate or restore the temperature of the hot rolled steel if the temperature of the steel to be quenched is not at the desired temperature. The rate of heating in the trimming unit can affect the upper critical temperature for recrystallization of the steel. A high rate of heating can raise the upper critical temperature above the upper critical temperature obtainable by a low rate of heating.

The quenching step (FIG. 1, block 26) can be performed by air, water or oil cooling, lead patenting or a simulation of lead patenting. Representative simulations include use of a high temperature quenching followed by controlled cooling using a molten zinc or zinc aluminum alloy bath, a fluidized bed or a film boiling technique. These simulations avoid the environmental problems of lead. The use of a zinc or zinc aluminum alloy also achieves a benefit of galvanizing the steel strapping at a relatively nominal cost. The quenched steel can be quenched to an isothermal transformation temperature of the steel. The isothermal transformation temperature is below $Ar_1$. An optional holding oven can be utilized to maintain the steel at the isothermal transformation temperature. The steel can then be quenched to ambient temperature using a conventional water quench.

The hot rolled steel entering the quenching step is preferably at a temperature above the austenitizing temperature range, i.e., above $Ar_3$, or within the austenitizing (recrystallization) temperature range, for the steel being processed.

When the molten bath in which the steel is quenched contains zinc or a zinc aluminum alloy, the steel is maintained in the bath for a time period effective to permit chemical deposition of the zinc or zinc aluminum alloy on the surface of the steel to galvanize the steel. Conventional methods of controlling the thickness of the coating can be utilized including adjusting the immersion time, mechanically wiping the quenched steel as it exits the bath and/or utilizing high temperature steam to remove a portion of the deposited zinc or alloy. The steel can exit the molten bath or high temperature steam treatment at a temperature of about 800° to about 1000° F. The steel can exit at the isothermal transformation temperature and then enter the holding oven to achieve isothermal transformation.

Figure 8:
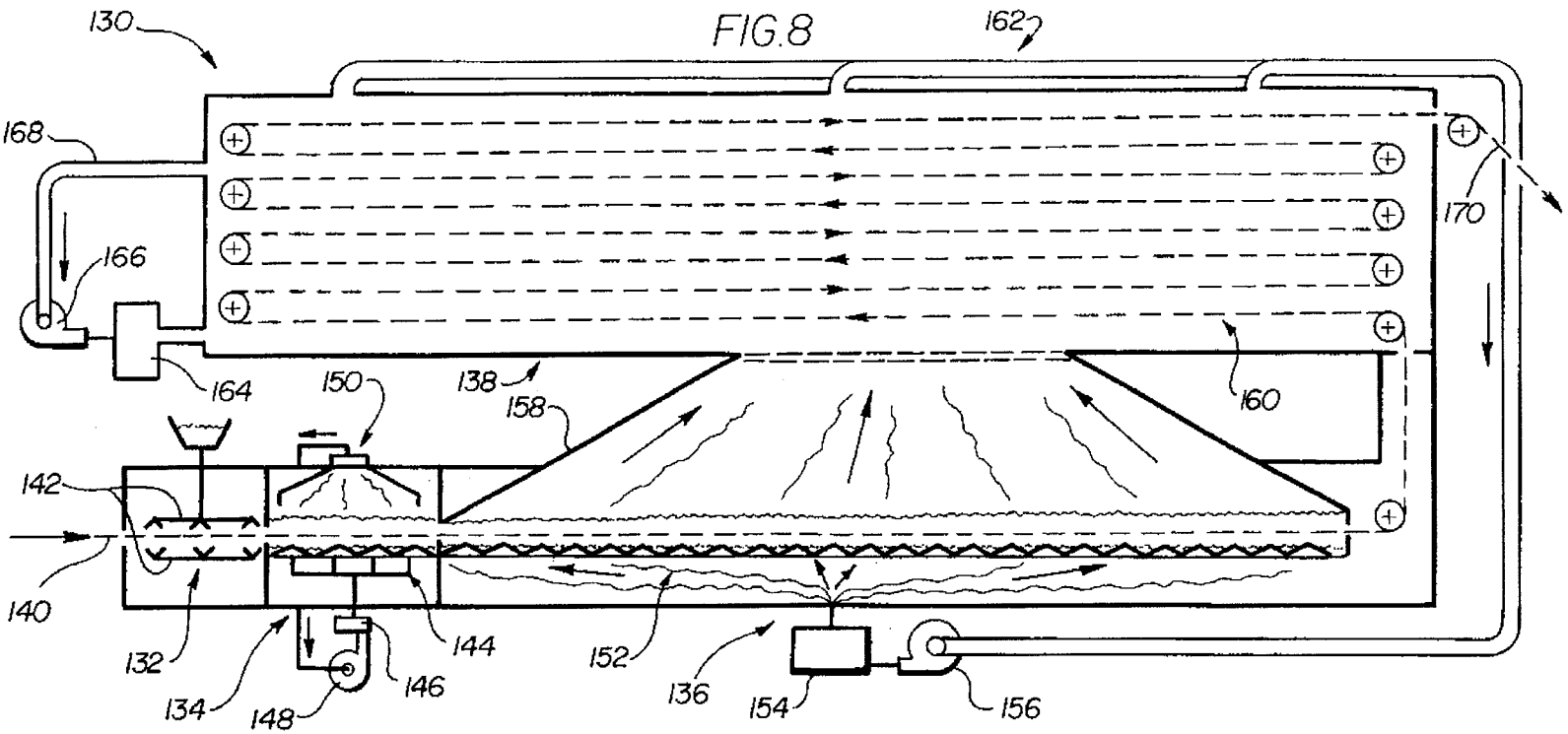
FIG. 8 is a representation of a quenching apparatus.

Alternatively, the quenching step (FIG. 1, block 26) can be performed by one or more fluidized beds as shown in FIG. 8. Although fluidized beds have been utilized for quenching round rods and wire, flat strapping and strip require different mechanical considerations. It is preferred that the flat strapping and strip be on edge as it moves through the fluidized bed to effect better heat transfer.

FIG. 8 illustrates a quenching apparatus 130 that is capable of duplicating the lead patenting cooling rates experienced during quenching. The quenching apparatus 130 has a water fog heat removal system 132, a first fluidized bed system 134, a second fluidized bed system 136, and a holding oven 138.

The lead patenting cooling rates are duplicated by utilizing the water fog heat removal system prior to the rolled steel 140 entering the first fluidized bed system 134. The water fog system has foggers 142 that generate a fog of water through which the steel 140 passes. Preferably, the steel 140 is turned 90° to a vertical orientation prior to entering the water fog system 132 to minimize the horizontal surface area upon which the water can rest. The steel 140 maintains the vertical orientation as it passes through the first fluidized bed system 134 and the second fluidized bed system 136 and is returned to the horizontal orientation for passage through the holding oven 138. A water fog is preferred over a water spray because of the uniformity of the fog pattern and the less drastic cooling rate obtained by the water fog. A water spray is also less desirable because the spray pattern is usually irregular resulting in a drastic cooling rate and because steam trapped at the steel/water interface can exert nonuniform forces on the steel that distort the steel.

The steel 140 then enters the first fluidized bed system 136 that includes a first fluidized bed 144 whose temperature is controlled by a heater/cooler unit 146 which heats or cools gas forced therethrough by a blower 148. The gas is recirculated by a recirculation system 150 to enhance the efficiency of the first fluidized bed system 134. Preferably, helium is utilized in place of air to control the temperature of the first fluidized bed 144 because helium has a cooling rate that can be about six times higher than the cooling rate of air.

The steel 140 then enters the second fluidized bed system 136 that includes second fluidized bed 152 whose temperature is controlled by a heater/cooler unit 154 which heats or cools gas forced therethrough by a blower 156. A recirculation conduit 162 permits recirculation of the gas back to the blower 156 and the heater/cooler unit 154 to improve the efficiency of the quenching apparatus 130. An inert gas such as nitrogen is used to control the temperature of the second fluidized bed 152 to inhibit reaction of the gas with the steel 140. If air is used as the gas the oxygen present in the air can oxidize the surface of the steel 140 which is undesirable. The gas introduced into the second fluidized bed can decarbonize the surface of the steel and thereby produce a carbon gradient from the surface to the center. The carbon gradient can, on final heat treatment, give a product having a hard core and a softer surface to give good strength and flexibility. The steel 140 can be maintained in the second fluidized bed 152 to reduce the temperature to the isothermal transformation temperature. The steel 140 can be maintained in the second fluidized bed 152 until completion of the metallurgical transformation or can be conveyed to a holding oven for completion of the metallurgical transformation.

The steel 140 exits the second fluidized bed system 136 and is turned 90° to the horizontal orientation and enters the holding oven 138. Heat from the second fluidized bed system 136 rises and is directed by a flue 158 into the holding oven 138. A heater/cooler unit 164 and a blower 166 are utilized to maintain the temperature of the holding oven 138 at the desired temperature. A recirculation conduit 168 returns gas to the blower 166 and the heater/cooler unit 164 to improve the efficiency of the quenching apparatus 130. The steel 140 follows a serpentine path 160 through the holding oven 138 which maintains the steel in the oven for a time period and at a temperature effective for completion of the metallurgical transformation, preferably to a final product with physical properties similar to or exceeding those of tempered martensite or bainite. The steel 170 exiting the holding oven 138 can be water quenched to ambient temperature using a conventional water quencher (not shown). Alternatively, the steel can be water quenched to ambient temperature after the optional warm rolling step.

The fluidized beds can utilize a mixture of molten salt and nonmolten sand with the sand minimizing the quantity of salt dragout. Alternatively, an aqueous solution containing a polymer quenchant can be used. Representative aqueous solutions are the sodium polyacrylate aqueous solutions disclosed in a technical bulletin by Kopietz entitled "Controlled Quenching of Ferrous Metals in Sodium Polyacrylic Aqueous Solutions", E. F. Houghton and Co., Valley Forge, Pa.

Representative of the gases suitable to decarbonize the surface are $O_2$2, O, $CO_2$ and the like.

An alternative quenching step is a direct patenting by film boiling technique. Film boiling involves use of an aqueous solution bath held at its boiling temperature. Takeo et al., "The Direct Patenting of High Carbon Steel Wire Rod by Film Boiling" Tetsu-to-Hagane, 60 (1974) 2135 discusses using film boiling as a batch process for patenting wire having a circular cross section wherein hot rolled wire rod is coiled in the bath. The Takeo et al. article does not indicate that film boiling has been used in a continuous process for the production of flat strapping or strip.

For low carbon steels the steel is preferably heated in the heating step (block 22) to a temperature in the range of about 1,400° to about 1,700° F. (which is above $Ar_3$), the hot rolling step (block 23) is preferably performed at a temperature in that range to obtain recrystallization and the quenching step (block 26) is preferably performed from a temperature in the range of about 1,400° to about 2,200° F. down to ambient temperature to produce martensite.

For dual phase steels, the steel is preferably heated in the heating step (block 22) to a temperature above $Ar_3$ ($Ar_3$ is typically a temperature in the range of about 1,400° to about 1,700° F.), the hot rolling step (block 23) is preferably performed at least partially at a temperature above $Ar_3$ and at least partially at an intermediate temperature in the range of $Ar_1$ to $Ar_3$ (preferably in the range of about 1,050° to about 1,450° F.) that can require cooling and heating before and during the hot rolling step and the quenching step (block 26) is preferably performed from a temperature in the range of $Ar_1$ to $Ar_3$ down to ambient temperature to produce martensite. It is presently theorized that the hot rolling step performed at a temperature in the range of $Ar_1$ to $Ar_3$ results in thermomechanically working an austenitic grain structure.

For medium (about 0.35 wt % carbon) and high carbon steels (about 0.55 wt % carbon), when the temperature of the steel prior to the quenching step is above the austenitizing temperature and strapping or strip having relatively less ductility and more tensile strength is desired, the steel is quenched to a temperature in the range of about 800° to about 900° F. to obtain a lower bainite grain structure. If strapping or strip having relatively more ductility and less tensile strength is desired, the steel is quenched to a temperature in the range of about 900° to about 1,000° F. to obtain an upper bainite grain structure.

When the steel is a dual phase, low carbon content steel or a microalloyed steel, the temperature reduction by quenching can be used to produce a dual phase martensitic/ferritic grain structure. Alternatively, the quenching step, especially the combination of the water fog system, first fluidized bed and second fluidized bed, can be utilized to rapidly quench the low carbon steel from a temperature in the range of $Ar_1$ to $Ar_3$ down to a temperature of about 300° to about 400° F. for full metallurgical transformation to a martensite in a soft ferrite matrix grain structure. Alternatively, the low carbon steel can be directly quenched in water or oil. The tensile strength and ductility of strapping having a martensite in a soft ferrite grain structure can be similar to steel having a higher carbon content.

For the manufacture of strip steel with a soft pearlitic, ferritic or mixed pearlitic/ferritic grain structure similar to that obtained by isothermal annealing, the steel is preferably heated in the heating step (block 22) to a temperature above 1,400° F. (which is above $Ar_3$), the hot rolling step (block 23) is performed at a temperature above $Ar_3$ to obtain recrystallization and the quenching step (block 26) is preferably performed from a temperature above 1,400° F. (which is above $Ar_3$) down to an isothermal transformation temperature in the range of about 900° to about 1,200° F. The steel is then maintained at the isothermal transformation temperature to complete transformation to obtain the desired grain structure.

For the manufacture of hardened strip steel (austempering), the steel is heated in the heating step (block 22) to a temperature above $Ar_3$, the hot rolling step (block 23) is preferably performed at a temperature above $Ar_3$ to obtain recrystallization and the quenching step (block 26) is performed at a rate to avoid the initiation of any transformation thus retaining the steel in an austenite form followed by isothermal transformation to obtain the desired structure. The temperature to which the steel is cooled by quenching and held is preferably above the temperature at which martensite starts to form. For example, for a 1050 steel the $Ar_3$ is about 1,400° F., the temperature at which martensite begins to form is about 610° F. and the nose of the transformation curve is positioned such that the steel must be cooled from above 1,400° F. to a temperature slightly above 610° F. in about 0.75 seconds.

The quenched steel exiting the quenching step (block 26) then enters the warm or cold rolling step (block 28) if the steel has been reduced close to its final thickness by hot rolling but additional reduction is necessary. The rolling step can include up to three passes for warm rolling. The quenched steel can be cooled to a temperature in the range of about 700° to about 900° F. for warm rolling. Warm rolling at that temperature range will elevate the yield strength of the strapping while at the same time not appreciably decreasing the ductility. Alternatively, the rolling step can be a cold rolling step wherein the strapping is cooled to ambient temperature prior to rolling. Cold rolling increases the strength but reduces the ductility of the strapping. The warm or cold rolling can reduce the thickness by up to about 50%. Typically, the steel is warm or cold rolled to reduce the thickness by about 5 to about 50%. Strapping made by this process can have a tensile strength of about 165 to 175 mpsi and 5% elongation. In higher carbon steels there is a slight but measurable increase in the width, called spread, as a result of rolling. The metallurgical grain structure obtained by warm or cold rolling exhibits tensile strength, ductility and the like for steel strapping or strip.

An alternative to the cold rolling is to use steel having a high carbon and manganese content that upon heat treatment will provide a higher strength.

If the steel exiting the quenching step is too soft due to over annealing to produce the desired strip the steel can be warm or cold rolled to reintroduce a degree of stiffness and hardness.

The warm or cold rolling step puts in directional properties resulting in the resistance to forming being greater in the direction of rolling than in the transverse direction.

The optional coating step (FIG. 1, block 30) can coat the strapping with a metal, paint or plastic. The coat could be used for identification, decoration and the like. A suitable metal would be zinc which would provide corrosion resistance and an excellent base for a subsequent paint operation. The zinc could be applied by dipping the strapping in a molten zinc bath. The paint can be zinc enriched. A plastic that is an exothermic coating and requires cooling can be advantageously applied to the warm strapping.

The starting material can be steel stock supplied as round rods or bars or flat bars or slit sheet having a large, medium or small cross-section. The steel stock can be coiled. The large cross-section rods and bars can have a diameter in the range of about 0.625 inches to about 1.25 inches. The small and medium cross-section round rods and bars can have a diameter of less than about 0.2 inches or in the range of about 0.2 to about 0.625 inches, respectively. The flat bars can have a width in the range of about 0.5 to about 3 inches and a thickness in the range of about 0.125 to about 0.625 inches. The flat slit sheet can have a width of about 0.5 to about 3 inches and a thickness in the range of about 0.06 to about 0.125 inches.

The grade of the steel utilized will affect the final physical properties of the strapping and strip. The final physical properties will also be dependent upon the operating conditions of the present process. Low carbon steel, i.e., steel having a maximum carbon content of about 0.25 wt % carbon, can be utilized. The maximum manganese content of the low carbon steel is preferably about 0.65 wt %. Alternatively, the steel can have a carbon content of about 0.55 wt % and a manganese content of about 0.30 wt %. Microalloyed steels, e.g., steels having up to about 2 wt % silicon and/or up to about 0.2 wt % titanium, can also be utilized. High strength strapping can be produced from AISI grades 1024 through 1061. Manganese steels can also be utilized. The manganese steels can have a manganese content over 1.5% and a carbon content in the range of about 0.20% to about 1.0%.

The high strength strapping can have a tensile strength in the range of about 125,000 to about 220,000 pounds per square inch (psi). Regular strength strapping can be produced from AISI grades 1008 through 1023 and/or from microalloyed steel. The regular strength strapping can have a tensile strength in the range of about 100,000 to about 125,000 psi.

Preferably, the strip is produced from a starting material having a carbon content in the range of about 0.1 to about 0.6 wt % and a manganese content in the range of about 0.3 to about 1.65 wt %. Steel starting material in the form of a round rod having a diameter of 0.75 inches can be transformed into a 2×0.02 inch strip by the present process. A flat starting material having the dimensions of 2×0.125 inches can be transformed to a ×2×0.02 inch strip by the present process. The strip can have a tensile strength in the range of about 135,000 to about 160,000 psi and a Rockwell 30N hardness of about 50 to about 54.

A typical process line of the present invention for 2×0.044 inch strapping and strip can have a maximum throughout of about 8 tons/hr and a speed of about 880 fpm, for 1 ¼×0.031 inch strapping and strip the process can have a maximum throughout of about 8 tons/hr and a speed of about 2,000 fpm and for ½×0.020 inch strapping and strip the process can have a maximum throughout of about 6 tons/hr and a speed of about 6,000 fpm.

The following Examples are provided by way of representation, and not limitation, of the present invention.

EXAMPLE 1: REDUCTION SCHEDULE AND ELONGATION FOR HOT ROLLING

The stands of the hot rolling step (FIG. 1, block 23 and FIG. 2) can be used for transform a round steel rod or bar having a diameter of 0.593 inches to steel strapping measuring 1.25×0.31 inches. A round rod or bar having a diameter of 0.218 inches can be transformed into strapping having dimensions of 0.50×0.020 inches.

TABLES I and II, below, provide reduction schedules for making 1.25×0.31 inches and 0.5×0.2 inch strapping, respectively, from an AISI grade 1040 steel that includes about 1 wt % manganese. The temperature of the steel entering the hot rollers is preferably about 1,600° F. speed at which the steel is traveling is preferably about 2,000 fpm for 1.25×0,031 inch strapping and about 6,000 fpm for 0.5×0.02 inch strapping out of the hot rolling step. TABLES I and II are based on plots generated by the Wusatowski spread formula.

TABLE I 1.25" × 0.031" Strapping From 0.593" Diameter Round Rod

| STAND (FIG. 2) | EXIT DIMENSIONS (Inches) | EXIT ELONGATION[1] (Percent) |
|---|---|---|
| oval (36) | — | 19.4 |
| round (38) | 0.487 (diameter) | 24.1 |
| flat (40) | 0.557 × 0.288 | 16.1 |
| edge (42) | 0.51 × 0.307 | 2.4 |
| flat (44) | 0.977 × 0.108 | 48.4 |
| flat (46) | 1.243 × 0.042 | 102.1 |
| flat (48) | 1.25 × 0.031 | 34.7 |

[1]Elongation that occurs at a stand is calculated by the following equation:

$$\text{Elongation (\%)} = \frac{\text{exit length} - \text{entry length}}{\text{entry length}} \times 100$$

TABLE II 0.5" × 0.020" Strapping From 0.218" Diameter Round Rod

| STAND (FIG. 2) | EXIT DIMENSIONS (Inches) | EXIT ELONGATION[1] (Percent) |
|---|---|---|
| oval (36) | — | 16.8 |
| round (38) | 0.184 (diameter) | 20.2 |
| flat (40) | 0.22 × 0.11 | 9.9 |
| edge (42) | 0.2 × 0.119 | 1.7 |
| flat (44) | 0.329 × 0.06 | 20.6 |
| flat (46) | 0.461 × 0.03 | 42.7 |
| flat (48) | 0.5 × 0.02 | 38.3 |

[1]Elongation that occurs at a stand is calculated by the following equation:

$$\text{Elongation (\%)} = \frac{\text{exit length} - \text{entry length}}{\text{entry length}} \times 100$$

As can be seen in TABLES I and II, the most significant change in width and thickness occurs at stand 44. A relatively minor increase in width occurs in stands 46 and 48.

EXAMPLE 2: STRAPPING MADE USING OPTIONAL COLD ROLLING STEP

Strapping was produced from a 0.5518 inch diameter round bar of AISI grade 1055 steel having 0.56 wt % carbon and 0.70 wt % manganese. The bar was hot rolled to a flat section having a width of 0.75 inches and a thickness of 0.58 inches, isothermally transformed in molten lead at a temperature of 850° F., cooled to ambient temperature and then cold rolled to a thickness of about 0.3 inches. The physical properties of the round bar prior to being made into strapping were normal for this type of steel. The ultimate tensile strength of the round bar was about 100,000 psi and the yield strength was about 80,000 psi. The physical properties of the strapping exhibited an ultimate tensile strength of about 170,000 psi, a yield strength of about 144,000 psi and 5% elongation on average for 3 test specimens.

EXAMPLE 3: PRODUCTION OF STRAPPING

Strapping can be produced using as a starting material round steel rod or bar having a diameter of 0.593 inches, a carbon content of 0.40 wt % and a manganese content of 1.00 wt %. The reduction schedule of EXAMPLE 1, TABLE I and the following parameters can be utilized: the steel exits the heating step (FIG. 1, block 22) at a temperature of about 1,600° F. and a speed of about 300 to about 400 fpm; is subjected to the hot rolling step (block 23) having the reduction schedule of EXAMPLE 1, TABLE I; exits at a temperature of about 1,600° F.; enters the quenching step (block 26) and is quenched utilizing a water fog and fluidized bed cooled with helium gas and exits the quencher at a temperature of about 800° F.; enters the warm rolling step (block 28) and is warm rolled at a temperature of about 500° F. and a speed of about 2,100 fpm to achieve about a 10% reduction; and enters the coating step (block 30) at a temperature of about 450° F. to about 500° F., is coated with a conventional coater and the coating is permitted to cure. Strapping having a tensile strength of about 130,000 psi can be produced.

EXAMPLE 4: PRODUCTION OF STRAPPING FROM SLIT STEEL

Strapping can be made using as a starting material slit strip of a steel having 0.35 wt % carbon and 1 wt % manganese that has the dimensions of 2×0.080 inch. The strip can be produced by heating the steel to a temperature of about 1,500° F., hot rolling the steel to 2×0.035 inches, quenching the steel down to a temperature of about 800° F., holding the steel at that temperature to isothermally transform the steel partially to ferrite and pearlite and then completing the transformation of the retained austenitc to martensite by a water quench to produce a ferrite, pearlite and martensite structure. The strapping can have a tensile strength of about 135,000 psi and about 6 to about 8% elongation.

EXAMPLE 5: PRODUCTION OF STRAPPING

Slit cold rolled steel having a maximum of 0.25 wt % carbon and a maximum content of 0.50 wt % manganese, a tensile strength of about 150,000 psi and dimensions of 0.5×0.020 inches was utilized to produce strapping having a tensile strength of about 220,000 to 240,000 psi and dimensions of 0.5×0.020 inches. Electric conduction heating was utilized to elevate the temperature of the starting material to above $Ar_3$ to obtain recrystallization followed by quenching the starting material in water to obtain a low carbon, martensitic grain structure. The strapping produced can have properties rendering it suitable for use as a cotton bale tie and other like applications requiring high tensile strength with low ductility. The strapping can be produced from 0.218 inch round rod by using the reduction schedule of EXAMPLE 1, TABLE II and a water quench.

EXAMPLE 6: PRODUCTION OF STRAPPING

A slit sheet starting material having about 0.135 wt % carbon and 0.485 wt % manganese, a tensile strength of about 118,750 psi and dimensions of 0.75×0.02 inches was utilized to produce strapping having a tensile strength of about 143,750 psi and dimensions of 0.75×0.020 inches. The starting material was heated to a temperature above $Ar_3$ and water quenched to produce the strapping. Strapping could have been produced from a round rod using a 0.593 inch diameter round rod and the reduction schedule of TABLE I to obtain 1.25×0.031 inch strapping or using a 0.218 inch diameter round rod and the reduction schedule of TABLE II to obtain 0.5×0.020 inch strapping.

EXAMPLE 7: PRODUCTION OF STRIP

Starting material in the form of a 0.5 inch steel round rod having 0.4 wt % carbon and 0.8 wt % manganese can be utilized to produce strip. The starting material is heated to a temperature above $Ar_3$ prior to hot rolling to produce 1×0.030 inch strip. TABLE III, below, provides a reduction schedule.

TABLE III

| 1" × 0.030" Strip From 0.5" Diameter Round Rod | |
|---|---|
| STAND (FIG. 2) | EXIT DIMENSIONS (Inches) |
| oval (36) | — |
| round (38) | 0.45 (diameter) |
| flat (40) | 0.50 × 0.3 |
| edge (42) | 0.45 × 0.3 |
| flat (44) | 0.8 × 0.1 |
| flat (46) | 0.9 × 0.04 |
| flat (48) | 1.0 × 0.03 |

A fluidized bed can be utilized to quench the steel to about 800° F. to obtain isothermal transformation to a lower banite grain structure. After isothermal transformation, the steel can be quenched to room temperature. The strip can have a tensile strength of about 140,000 psi and a Rockwell 30N hardness of about 52.

This invention has been described in terms of specific embodiments set forth in detail, but it should be understood that these are by way of illustration only and that the invention is not necessarily limited thereto. Modifications and variations will be apparent from this disclosure and can be resorted to without departing from the spirit of this invention, as those skilled in the art will readily understand. Accordingly, such variations and modifications of the disclosed invention are considered to be within the purview and scope of this invention and the following claims.

What is claimed is:

1. A method of making steel strapping or strip from a steel piece having a thickness and a width, the strapping or strip having a finished thickness, length and width, the method comprising the steps of:

providing a steel piece having a thickness greater than the thickness of the finished strapping or strip;

heating the steel piece to an elevated temperature greater than the upper critical temperature for the steel to form a heated steel piece;

hot rolling the heated steel piece to reduce the thickness of the heated steel piece to form a hot rolled steel piece while preventing expansion of the width of the hot rolled steel piece beyond the finished width of the steel strapping or strip, wherein the hot rolling step comprises at least seven stands and the roll pass designs of the at least seven stands includes in the following order, ovalization, precision rounding, rectangle forming, edge rolling and three thickness reducing roll pass designs; and then quenching the hot rolled steel piece from a temperature selected from the group consisting of temperatures above the upper critical temperature for the steel and temperatures between the lower critical temperature and the upper critical temperature for the steel to form strapping or strip.

2. The method of making strapping or strip in accordance with claim 1 wherein the hot rolling step is performed partially at a temperature above the upper critical temperature and partially at a temperature between the lower critical temperature and the upper critical temperature and the quenching step is performed from a temperature between the lower critical temperature and the upper critical temperature.

3. The method of making strapping or strip in accordance with claim 1 wherein the quenching step comprises the steps of partially quenching the rolled steel piece using a water fog heat removal process and partially quenching the rolled steel piece using a helium fluidized bed process.

4. The method of making strapping or strip in accordance with claim 3 wherein the quenching step results in a grain structure having the physical characteristics of a grain structure selected from the group consisting of a bainite grain structure, dual-phase grain structure of pearlite in a martensite grain structure and martensite in a soft ferrite matrix grain structure.

5. The method of making strapping or strip in accordance with claim 1 wherein the quenching step is performed from a temperature in a temperature range selected from the group consisting of temperatures in the range of about 1,400° F. to about 2,200° F. and temperatures in the range of about 800° F. to about 1,000° F. and the steel piece is quenched down to about ambient temperature.

6. The method of making strapping or strip in accordance with claim 1 wherein the quenching step is performed to quench the steel piece down to a temperature below the lower critical temperature.

7. The method of making strapping or strip in accordance with claim 1 wherein the quenching step reduces the temperature of the hot rolled steel piece from a temperature above the upper critical temperature to an isothermal transformation temperature that initiates the transformation of the steel piece to ferrite, pearlite or bainite.

8. The method of making strapping or strip in accordance with claim 1 wherein the quenching step is performed from a temperature above the upper critical temperature to a temperature at which martensite starts to form at a rate that avoids the initiation of transformation to grain structures other than martensite.

9. The method of making strapping or strip in accordance with claim 1 further comprising the step of isothermally transforming the steel piece after the quenching step.

10. The method of making strapping or strip in accordance with claim 1 further comprising the step of rolling the steel piece after the quenching step.

* * * * *